US006092540A

United States Patent [19]

Chiao

[11] Patent Number: 6,092,540

[45] Date of Patent: Jul. 25, 2000

[54] SINK SIDE DISHWASHER

[76] Inventor: Yen-Nian Chiao, 3637 Puente Ave., Baldwin Park, Calif. 91706

[21] Appl. No.: 09/218,646

[22] Filed: Dec. 22, 1998

Related U.S. Application Data

[60] Provisional application No. 60/079,979, Mar. 30, 1998.

[51] Int. Cl.[7] ..... B08B 3/00

[52] U.S. Cl. ..... 134/57 DL; 134/99.2; 134/115 R; 134/133; 134/181; 134/201

[58] Field of Search ..... 134/57 DL, 99.2, 134/115 R, 133, 181, 201

[56] References Cited

U.S. PATENT DOCUMENTS

| | | | |
|---|---|---|---|
| 1,995,927 | 3/1935 | Kirby | 134/115 R X |
| 2,405,147 | 8/1946 | Kauffman | 134/115 R X |
| 2,632,452 | 3/1953 | Spitzer | 134/115 R |
| 3,101,730 | 8/1963 | Harris et al. | 134/181 X |
| 3,926,668 | 12/1975 | Ross | 134/99.2 X |
| 4,296,768 | 10/1981 | Saucedo . | |
| 4,368,747 | 1/1983 | Taylor . | |
| 4,420,005 | 12/1983 | Armstrong . | |
| 4,535,795 | 8/1985 | Taylor . | |
| 4,542,756 | 9/1985 | Gibson . | |
| 4,557,283 | 12/1985 | Shaw . | |
| 5,518,014 | 5/1996 | McEachen . | |

*Primary Examiner*—Philip R. Coe

[57] ABSTRACT

A sink side dishwasher is designed to use the same faucet of the water sink as its water source. It comprises an oscillating spray arm equipped with improved nozzles, an improved soap dispenser, a specially designed dish rack, and a specially designed washing house to cooperate with the unique structure of the dishwasher and other components to achieve of manufacturing an useful and operative dishwasher.

1 Claim, 7 Drawing Sheets

SINK SIDE DISHWASHER

This application claims benefit of Provisional Application Ser. No. 60/079,979 filed Mar. 30, 1998.

TECHNICAL FIELD

The field of the inventive sink side dishwasher relates to a portable counter top dishwasher, developed to the objects of simplicity, effectiveness, easy installation, ease of use, energy saving, and economic to manufacture. Said dishwasher comprises an improved soap dispenser, an oscillating spray arm equipped with improved nozzles, a specially designed dish rack, and a specially designed washing house, all which cooperate with the unique structure of the dishwasher and other components to accomplish an useful and operative dishwasher. With its size 24"D×20"W×17"H, the present invention offers significant advantages in terms of portability and convenience. It is ideal for smaller families and renters where conventional dishwasher is absent or simply not feasible to be installed.

BACKGROUND OF THE INVENTION

The present invention relates to a portable countertop dishwasher positioned adjacent to a water sink. Prior art dishwashers of various types have been indicated in the prior art as exemplified by the U.S. Pat. Nos.: 4,296,768. 4,420,005. 4,368,747. 4,535,795. 4,557,283. 4,542,756. and 5,518,014. However, as far as we are aware, portable countertop dishwashers have not been successfully marketed.

The present invention can be distinguished from the prior arts by:

1. The present invention mainly comprises an improved soap dispenser, an oscillating spray arm equipped with improved nozzles, and a specially designed dish rack which are not found in the prior arts.
2. The present invention has a unique structure design that develops the dishwasher to a compact size yet has large enough washing space to accommodate dishes, glasses, bowls and silver wares used by a small family during the day.

With the simplicity in its structure, the present invention would be economical to manufacture. With the simplicity and convenient to use, the present invention would be favored by all users.

SUMMARY OF THE INVENTION

The present invention is a dishwasher for positioning at the side of a water sink, to use the same faucet of the water sink as its water source. The embodiment of the said dishwasher comprises a water valve, a soap dispenser, a water pump, which all line up to a water tube and located outside the main body of the said dishwasher, and the main body that consists a washing house and a motor house. In the washing house, there are two fixed water spray arms mounted along the top edge of the side walls of the washing house, and an oscillating spray arm located at the bottom center, half inch above the floor, to perform the washing task. In the motor house, there are one D.C. motor and one I.C. module that control the operation of the above said components.

To proceed with the washing operation, the user jest needs to do the following:

1. Load the dishes from water sink to the dish rack seat at the side, then push the rack inside the washing house, then close the door.

2. Fill liquid detergent to the soap container then close the cover.
3. Turn on the hot water from the faucet on the water sink.
4. Press the general electric switch, after that the user can leave and have the dishwasher to start and finish the washing and rinsing cycles then stop automatically, dishes can be left inside for air dry.

Objects and advantages of this invention are simplicity, portability, effective, easy to install, easy to use, energy saving, and economic to manufacture, all these will become apparent from the following description taken in conjunction with the accompanying drawings.

DETAIL DESCRIPTION

Figure 1:
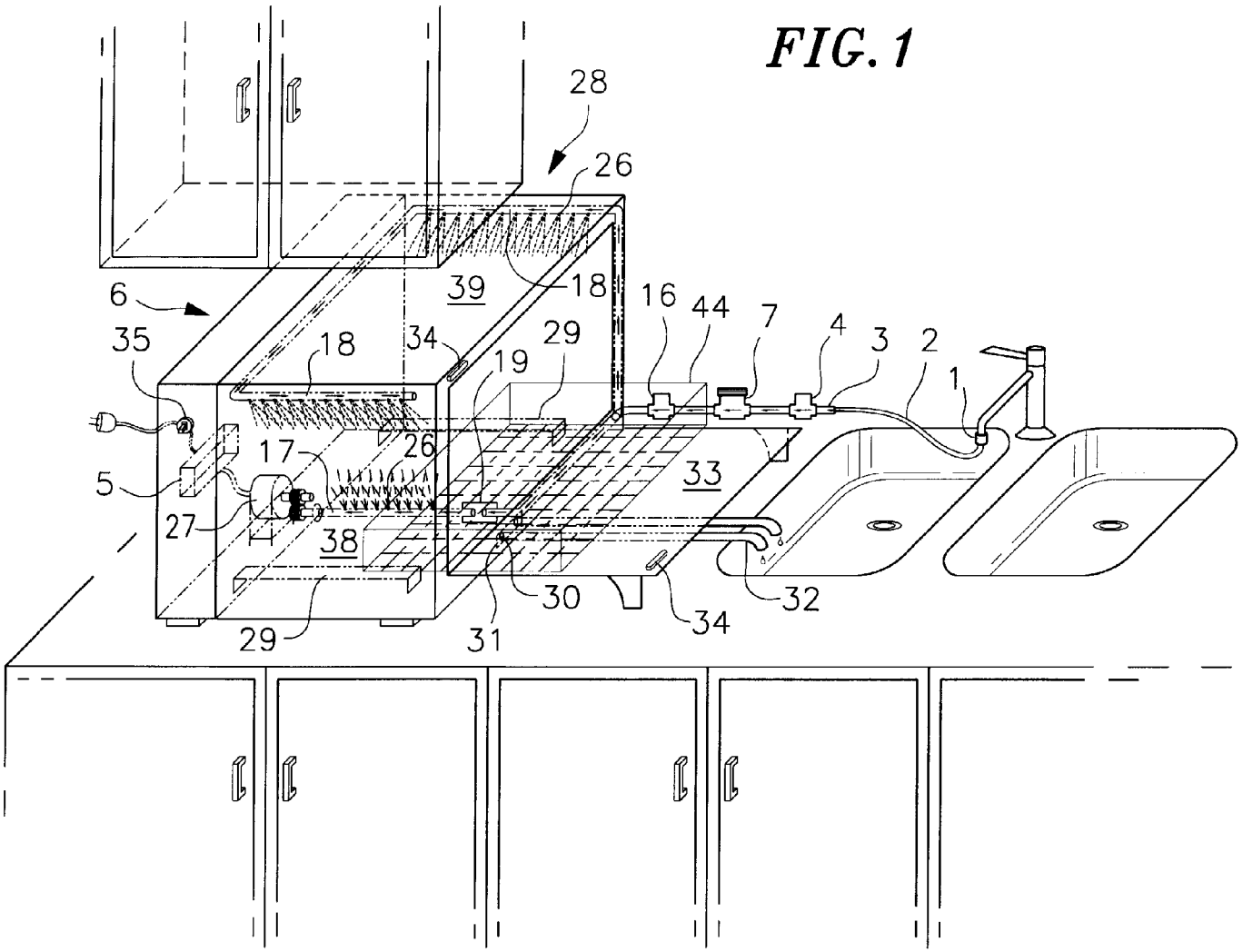
FIG. 1 is a perspective illustration of the invention with locations of all its components.

In the present invention FIG. 1 is a dishwasher that uses any typical kitchen faucet as its water supply source through the use of a two ways diverter 1 that replaces the existing aerator on any kitchen faucet. Water is fed through the flexible PVC tubing 2, which is connected to a ½" rigid PVC tube 3 at its other end, to the water valve 4.

Incoming water going into the said dishwasher will be controlled by the water valve 4, which shall be turned on when the dishwasher is in use and be shut off otherwise. This water valve 4 is controlled by the I.C. module 5 located inside the motor house 6.

Figure 2:
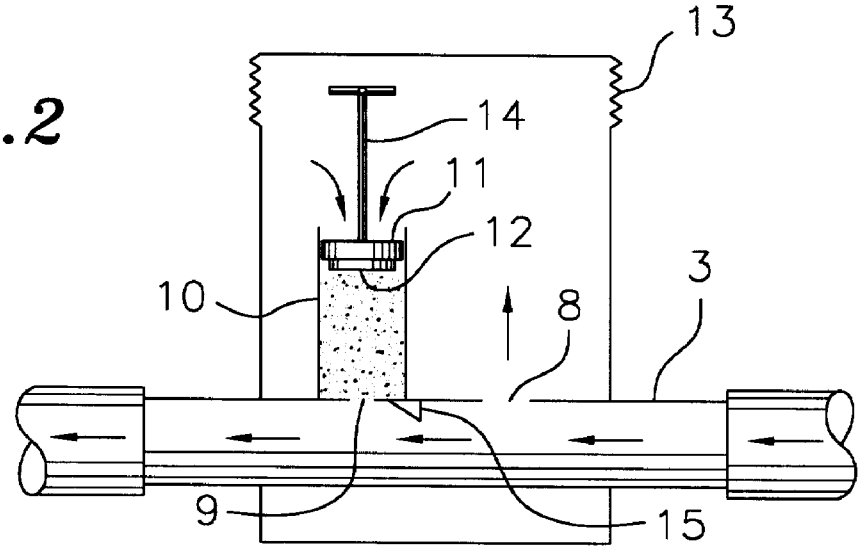
FIG. 2 is the cross side view of the improved soap dispenser.
Figure 3:
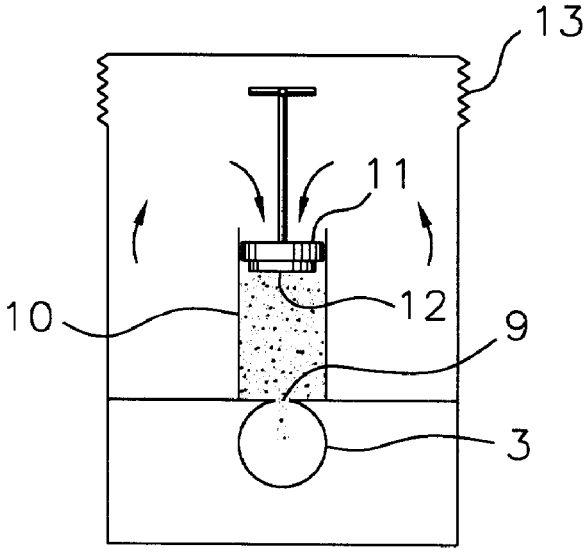
FIG. 3 is the cross front view of the soap dispenser.
Figure 4:
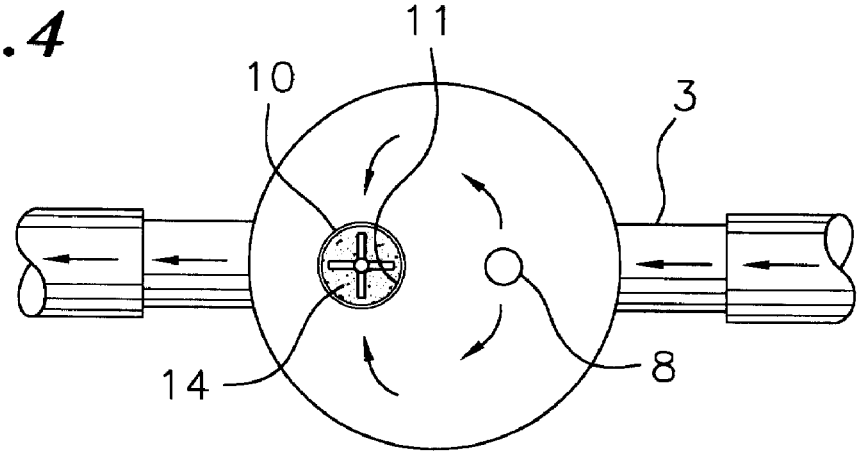
FIG. 4 is the top view of the soap dispenser.

Water passing through the water valve 4 will pass through a soap dispenser 7, which measures around 2.5" in diameter and 2.5" high. This cylindrical soap dispenser 7 is affixed to a ½" rigid PVC tube 3. There are two holes at the bottom of the soap dispenser 7 as shown in FIG. 2, the inlet hole 8, measured 3 mm in diameter, is for water inlet, and the outlet hole 9, measured 1.5 mm in diameter, is for the soap to exit the dispenser 7. Built directly on the smaller hole is a 1" diameter and 1.5" high cylindrical soap container 10. Inside this soap container is a ¼" thick piston device 11 with rubber cushion 12 at the bottom. When liquid soap is added to the said soap container 10, once water goes into the dispenser 7 through the inlet hole 8, pressure is formed inside the entire dispenser 7 and the soap will gradually exit the outlet hole 9 generated by the piston 11 to mix with the flowing water in the water tube 3. Then the water goes through the water pump 16 shown in FIG. 1, then flows to the oscillating spray arm 17 FIG. 1 and the fixed spray arms 18 shown in FIG. 1. Hence, the dishwasher starts the washing cycle. Once all the soap has been exited, the cushion 12 on the piston 11 will seal up the outlet hole 9 to prevent any residue soap coming out. Hence, the dishwasher starts the rinse cycle automatically. On top of the soap dispenser 7 is a screw type of cover 13 that allows users to fill soap into the soap container 10. This cover also helps to confine the piston 11 at the correct position by means of a piston rod 14. Between the outlet hole 9 and inlet hole 8, inside the water tube, there is a triangle shape small blocking piece 15 that is used to increase the pressure of the incoming water to going into the soap dispenser 7 through inlet hole 8, meanwhile to decrease the pressure outside the outlet hole 9. Hence, the soap can be exited the soap container 10 fluently.

Flowing water in water tube 3 mixing up with the soap from the soap dispenser 7 is fed into the water pump 16, through which the soapy water will be pressurized to provide adequate spraying power for both the oscillating spray arm 17 and the fixed spray arms 18.

Figure 5:
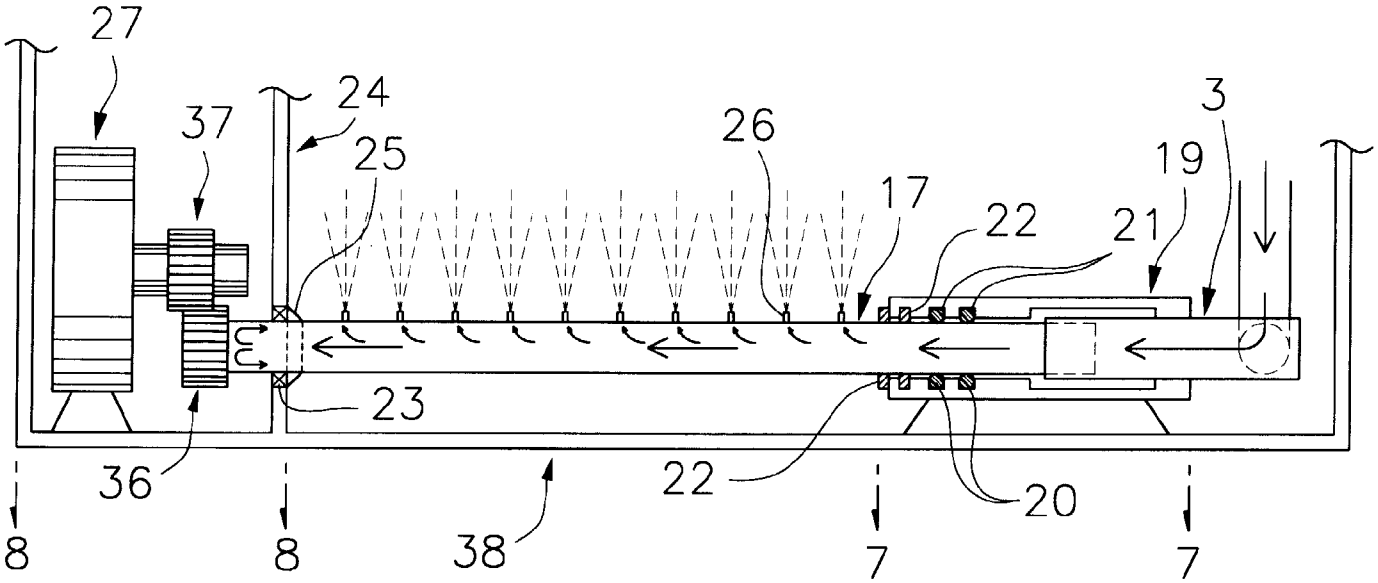
FIG. 5 is the cross side view of the oscillating spray arm and its relative components.
Figure 7:
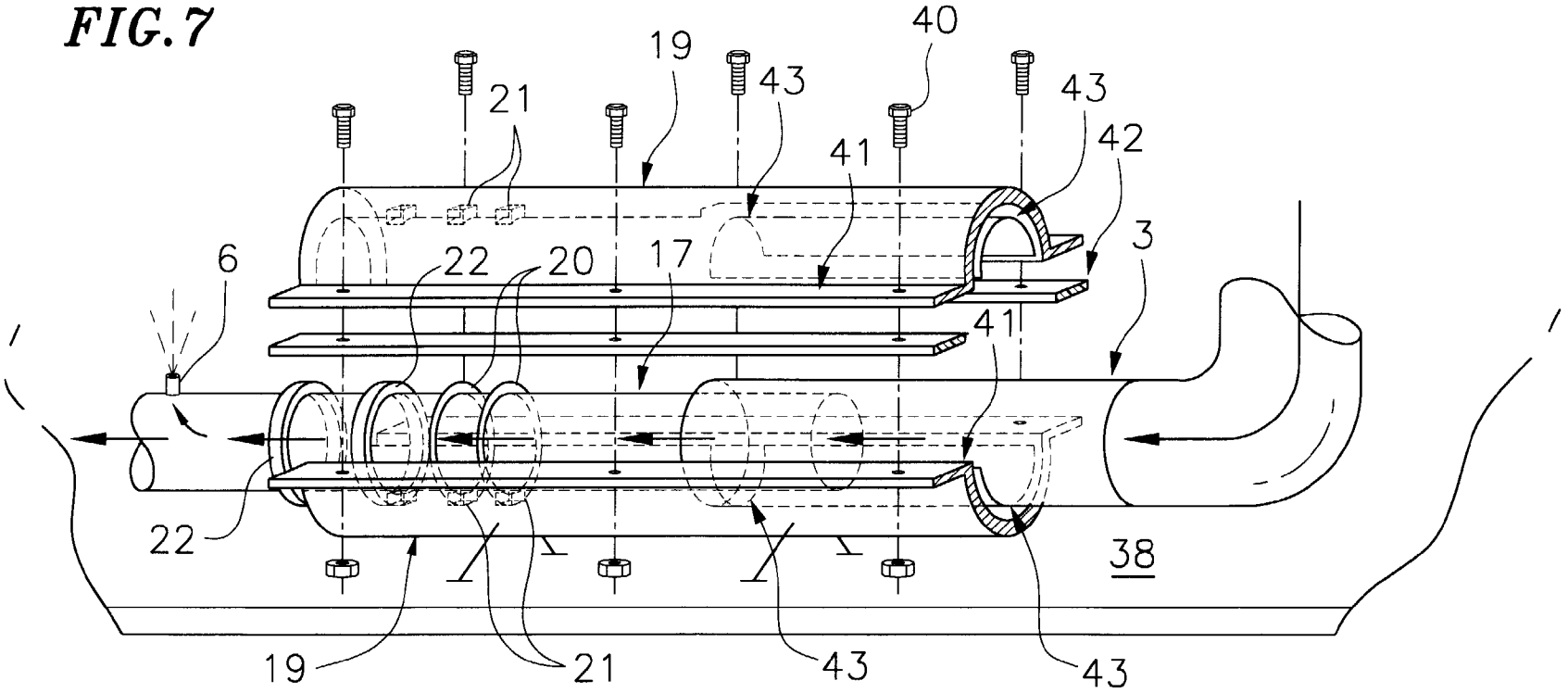
FIG. 7 is an enlarged cross-sectional illustration, taken along the line 7—7 of FIG. 5.

The copper oscillating spray arm 17 shown FIG. 5, is held by a sleeve connector 19 at one end and by the ball bearing ring 23 at the other end. Inside the inner wall of the sleeve connector 19 shown in FIG. 5 and FIG. 7, there are two notched-out channels 21, which are to accommodate with two O-rings 20 to hold the oscillating spray arm 17 and let the oscillating spray arm 17 oscillate smoothly, mean while to restrict water loss through the sleeve connector 19 as well. The sleeve connector 19 shown in FIG. 7 is so designed that it can be opened in half and closed back by using the bolts 40 on the side wedge 41 of the connector 19 with the rubber cushion 42 in between. Between the sleeve connector 19 and the water tube 3, there is another rubber cushion 43 for the purpose of holding the water tube 3 firmly, and the sleeve connector is secured to the bottom floor 38.

Figure 8:
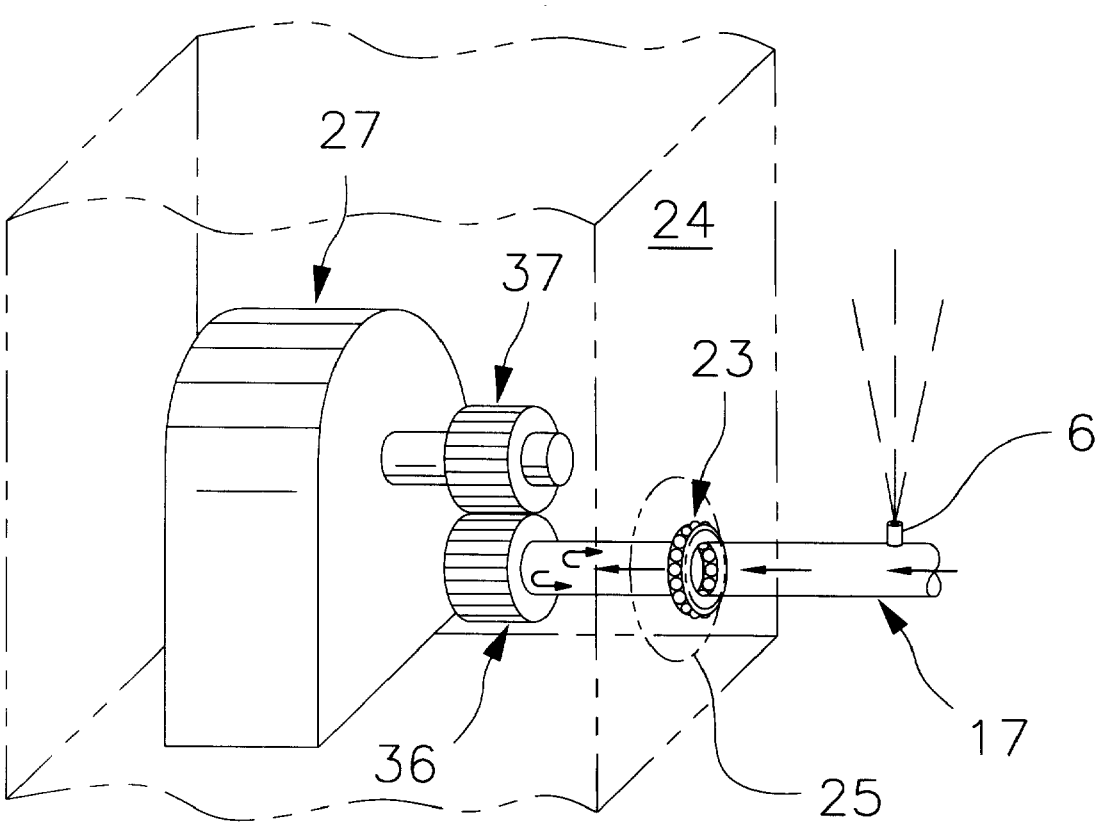
FIG. 8 is an enlarged cross-sectional illustration, taken along the line 8—8 of FIG. 5.

The other end of the oscillating spray arm 17 is held by a ⅜" diameter ball bearing ring 23 shown in FIG. 8 located at the rear wall 24 of the washing house 28. In front of the ball bearing ring 23 and on the oscillating arm 17, there is a rubber sleeve 25 mounted on the wall 24 to prevent water from going to the motor house 6. The copper oscillating spray arm 17 shown in FIG. 5, FIG. 7, and FIG. 8 is ⅜" in diameter and 18" long. One open end is directed to meet the incoming water tube 3 by means of the sleeve connector 19. The other dead end with gears 36, through the ball bearing ring 23, is extended to the motor house 6. Two metal washers 22, one at each side of the end of the sleeve connector 19, are attached to the copper oscillating spray arm 17 to prevent it from sliding out of position. The oscillating spray arm 17 is equipped with eight improved nozzles 26 shown in FIG. 6 to provide thorough spraying effect. The oscillating spray arm 17 oscillates 180 degrees each cycle through the effect of the gears 36 fixed at the dead end actuated by the gears 37 of the D.C. Motor 27 located in the motor house 6.

Besides the oscillating spray arm 17, there are two 16" long fixed spray arms 18 shown in FIG. 1 located along the top edge of the side walls 39 of the washing house 28, that are primarily used to wash the back side of dishes and to supplement the oscillating spray arm 17. Each arm also equipped with eight nozzles 26.

Figure 6B:
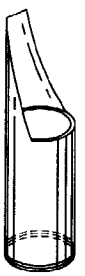
FIGS. 6A and 6B are a side and front view of a nozzle.
Figure 6A:
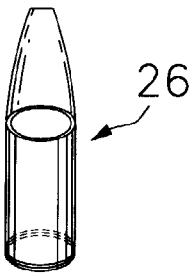

Each nozzle 26 shown in FIG. 6, made of copper, is a tiny hollow tube measured 2 cm in height and 3 mm in diameter. It is screwed to the spray arm. Its upper part is designed to such shape like a tea spoon. Through these nozzles, the projected water gets more impetus and sprays wider.

The I.C. module 5 shown in FIG. 1 consists of a timer that controls the timing of the entire operation. It controls the on and off of both the water pump 16 and the water valve 4 for the entire operation during which the dishwasher is turned on. It also contains the electrical circuit that controls the D.C. Motor 27 to operate the oscillating spray arm 17, and the circuit to the general switch 35.

The dishwasher consists of a washing house 28 shown in FIG. 1 with an inside dimension of 19"D×16"W×15"H, and a smaller motor house 6 shown in FIG. 1, 3"D×16"W×15"H, which houses the D.C. motor 27 and the I.C. module 5. The washing house, except the spray arms, is equipped with rails at both sidewalls 39 to hold the dish rack 44 for easy sliding in and out. The floor 38 of the washing house 28 is built at a five degree slope and two drain holes 30, with a screen 31 in front, are located at the floor front for draining purposes. Two flexible hoses 32 connected to the drain holes for draining the water to the sink. The front door 33 of the washing house 28 is designed to face the sink. It can be opened and laid on the countertop to become a flat surface on which the dish rack rests on during loading and unloading of dishes. A latch switch 34 is installed on the top edge of the front door 33 to prevent the dishwasher from running when the front door 33 is in the open position.

Figure 9:
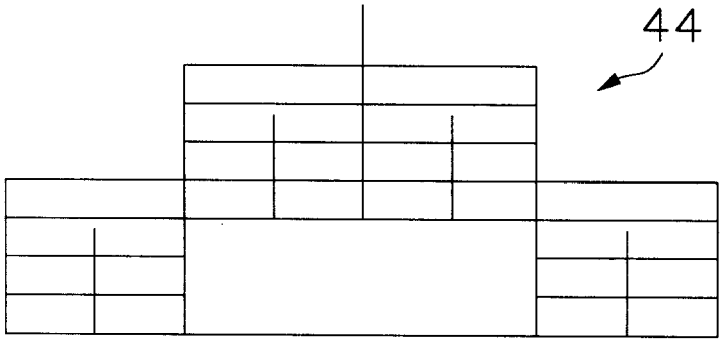
FIG. 9 is the front view of the dish rack.
Figure 10:
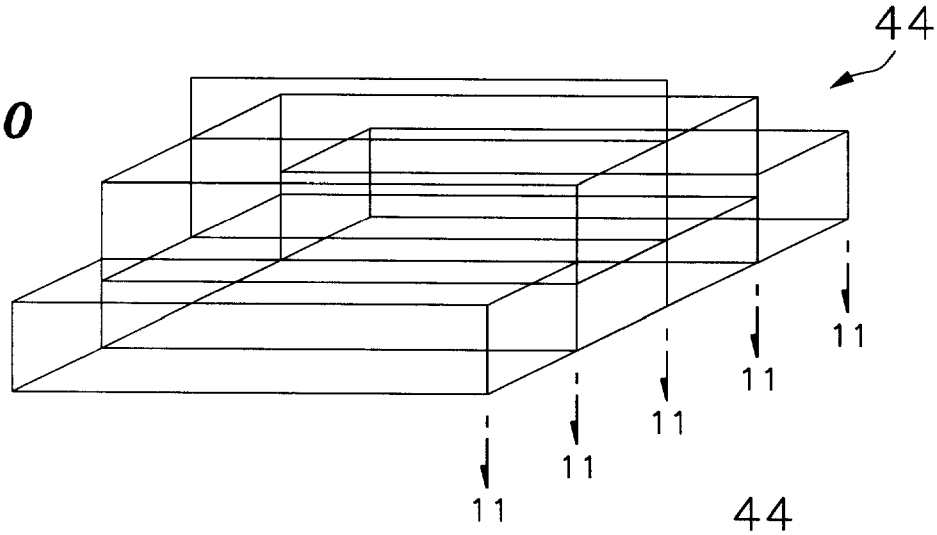
FIG. 10 is the side view of the dish rake.
Figure 11:
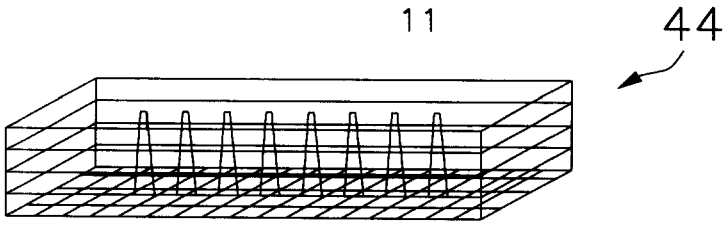
FIG. 11 is the sectional illustration of the dish rack, taken along the lines 11—11 of FIG. 10.
Figure 12:
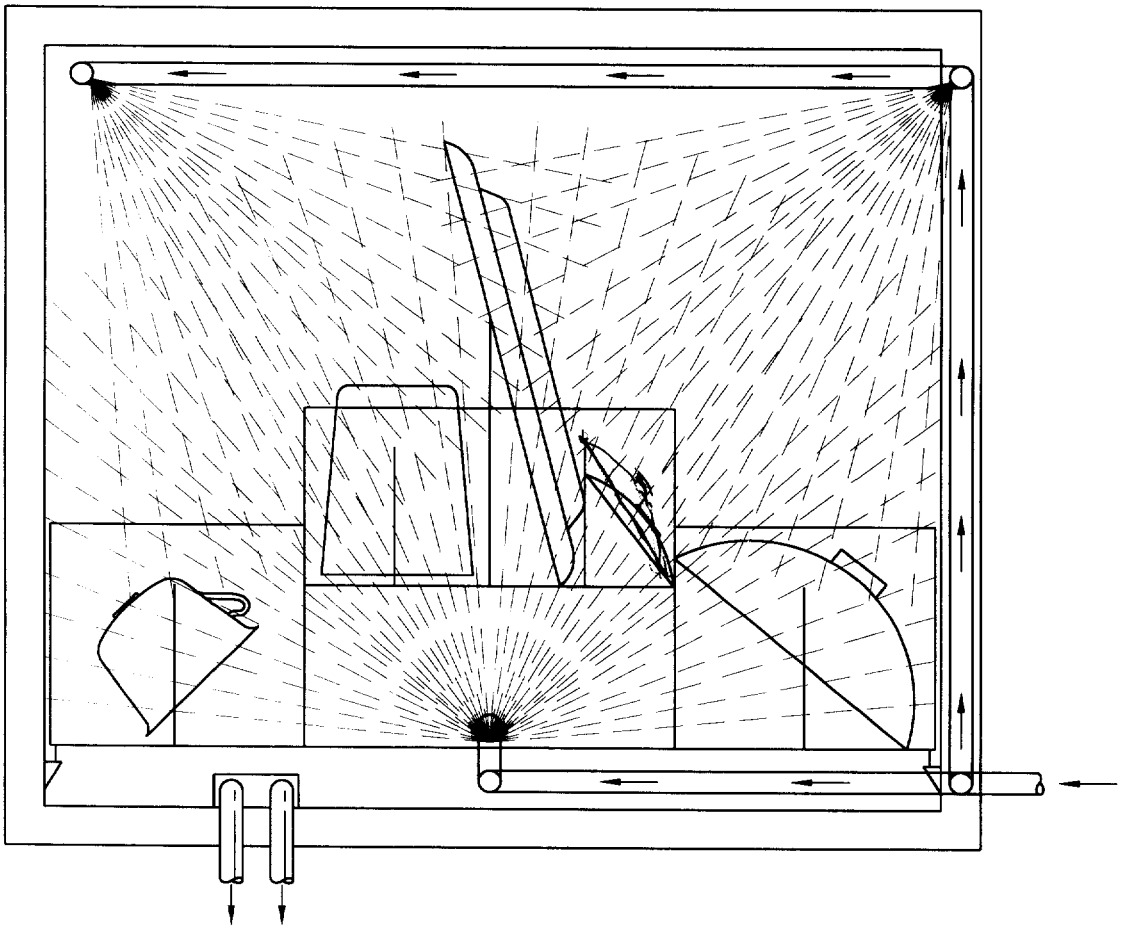
FIG. 12 is a perspective illustration of the washing condition of the dishwasher.

The improved dish rack shown in FIGS. 9, 10, and 11 for the dishwasher is so designed that all the dishes and cups loaded will be faced against the oscillating spray arm 17 with the front, and against the fixed spray arms 18 with the back. The total size of the dish rack is 16"W×16"D×8"H, divided into four compartments, the two center compartments of the rack are designed to be three inches higher than the side compartments as shown in FIG. 10, and each compartment is so designed as shown in FIG. 11 for proper dish loading, so that all the dishes can be washed thoroughly. For pots and pans, conventional flat racks can be used.

All of the above description is considered of the principles of this invention. To those skilled in the art, suitable modifications and equivalents may be resorted to falling within the scope of the invention, such as may add a heating system to it, or move the water valve, the soap dispenser, and the water pump to the motor house, and etc.

What I claim as my invention is:

1. A sink side dishwasher comprising an oscillating spray arm equipped with nozzles, a soap dispenser, a dish rack, and a washing housing:

the oscillating spray arm being held by a sleeve connector at one end thereof and by a ball bearing ring at the other end thereof, two metal washers, one at each end of the sleeve connector, being attached to the spray arm to prevent it from sliding out of position, the sleeve connector defining an inner wall wherein two notched-out channels are provided to accommodate two o-rings that hold the spray arm, permit smooth oscillation thereof, and restrict water loss, the sleeve connector being further designed so that it can be opened in half for maintenance when necessary by means of removable bolts provided through side wedges of the sleeve connector, a rubber cushion provided between the side wedges when the sleeve connector is closed, another rubber cushion provided between the sleeve connector and an incoming water tube for holding the incoming water tube firmly, the sleeve connector being secured to the floor of the washing housing, gears fixed the other end of the spray arm to be actuated by the gears of a D.C. motor to perform the oscillation of the spray arm;

the oscillating spray arm being equipped with eight nozzles with each nozzle shaped like a teaspoon at a top thereof and being provided with screws at a bottom thereof for securing the nozzles to the spray arm;

the soap dispenser being cylindrical, measuring 2.5" in diameter and 2.5" high, and being affixed to a PVC water tube, two holes provided at the bottom of the soap dispenser, one hole defining a water inlet hole and measuring 3 mm in diameter and the other hole defining a soap outlet hole and measuring 1.5 mm in diameter, a soap container measuring 1" in diameter and 1.5" high built directly on the outlet hole, a ¼" thick piston device, with a rubber cushion attached to the bottom of the piston device, located inside the soap container, whereby once water enters the dispenser through the inlet hole, pressure is formed by the piston device such that water, mixed with a liquid soap provided within the soap container, will gradually exit through the outlet hole to further mix with additional water flowing through the water tube, a water pump connected to the water tube to supply the mixed water and soap to the oscillating spray arm as well as to any additional spray arms within the washing housing to start a wash cycle, the rubber cushion on the piston device serving to seal the outlet hole to prevent any residue soap from flowing through the outlet hole during a subsequent rinse cycle, a screw cover being provided on top of the soap dispenser that allows filling of the soap dispenser as well as to help confine the piston device at a correct position by means of a piston rod that cooperates with the cover, a small triangular-shaped blocking piece being positioned inside the water tube between the inlet hole and the outlet hole that is used to increase the pressure of the water going into the soap dispenser through the inlet hole and to decrease the pressure of the water flowing through the water tube past the outlet hole so that the mixed water and soap can exit the soap container more smoothly, the dish rack including two center compartments and two side compartments with the center compartments being three inches higher than the side compartments; and the washing housing having an inside dimension of 19"D×16"W×15"H, the washing housing having a floor built at a 5-degree slope and a front door with two drain holes under the front door, the drain holes being connected to flexible hoses that drain water to the sink, the front door designed to face the sink such that it can be opened and laid on a counter top to become a flat surface on which the dish rack rests during loading and unloading, a latch switch installed at a top edge of the front door to prevent the dishwasher from running when the door is in an open position, the washing housing having sidewalls which are each equipped with a rail to hold the dish rack and for allowing the convenience of sliding the dish rack into and out of the washing housing.

* * * * *